US006621020B2

(12) United States Patent
Toyama et al.

(10) Patent No.: US 6,621,020 B2
(45) Date of Patent: Sep. 16, 2003

(54) BREAKING MECHANISM FOR CIRCUIT BREAKER

(75) Inventors: Kentaro Toyama, Tokyo (JP); Naoshi Uchida, Saitama (JP); Tatsunori Takahashi, Saitama (JP); Seiichi Suzuki, Saitama (JP); Tsuneo Fujiwara, Saitama (JP); Yoshinobu Hamada, Saitama (JP); Nobuhiro Sekine, Saitama (JP); Yoshimi Jumonji, Saitama (JP); Toshizo Kaihoku, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 150 days.

(21) Appl. No.: 09/983,022

(22) Filed: Oct. 22, 2001

(65) Prior Publication Data

US 2002/0047761 A1 Apr. 25, 2002

(30) Foreign Application Priority Data

Oct. 25, 2000 (JP) ..... 2000-325507
Jul. 4, 2001 (JP) ..... 2001-203169

(51) Int. Cl.[7] ..... H01H 3/16

(52) U.S. Cl. ..... 200/61.76; 200/400; 200/50.02; 200/318; 200/321

(58) Field of Search ..... 200/400, 401, 200/17 R, 50.02–50.09, 50.12–50.19, 318, 321

(56) References Cited

U.S. PATENT DOCUMENTS 4,596,310 A * 6/1986 Hatakeyama et al. ..... 185/40 R
5,634,554 A * 6/1997 Dimarco et al. ..... 200/401
5,821,487 A * 10/1998 Groves et al. ..... 200/50.02
6,087,609 A * 7/2000 Thilker et al. ..... 218/22
6,265,680 B1 * 7/2001 Robertson ..... 200/293
6,437,269 B1 * 8/2002 Rakus ..... 200/400

* cited by examiner

*Primary Examiner*—Elvin Enad
*Assistant Examiner*—K. Lee
(74) *Attorney, Agent, or Firm*—Kanesaka & Takeuchi

(57) ABSTRACT

A breaking mechanism includes a latch receiver engaging a latch to allow a movable contact shoe to be closed, and a tripping device for rotationally driving the latch receiver to disengage the latch to open the movable contact shoe. An engaging surface of the latch engaging the latch receiver is formed as a projecting circular surface, whereas an engaging surface of the latch receiver engaging the projecting circular surface is formed as a recessed circular surface having a radius of curvature greater than that of the projecting circular surface. The center of the curvature of the recessed circular surface coincides with the axis of a support shaft supporting the latch receiver. The loads causing a tripping device to drive the latch receiver do not change even if the location of an engaging point is changed.

5 Claims, 5 Drawing Sheets

BREAKING MECHANISM FOR CIRCUIT BREAKER

BACKGROUND OF THE INVENTION AND ART STATEMENT

The present invention relates to a breaking mechanism for a circuit breaker, such as a molded-case circuit breaker or an earth-leakage circuit breaker, and in particular, to the shapes of engaging surfaces between a latch for locking a toggle link when a movable contact shoe is closed and a latch receiver for engaging and locking the latch.

A breaking mechanism for a circuit breaker as mentioned above generally comprises a latch supported rotationally movably, and a latch receiver supported rotationally movably and generally engaging and locking the latch to prevent the rotational movement thereof. The latch locks a toggle link to keep an interrupting spring in a force-stored state when a movable contact shoe is closed, and the latch is released from the engagement and then rotationally moved to unlock the toggle link to open the movable contact shoe using the force stored in the interrupting spring when the current flowing through the circuit breaker becomes excessive to operate a tripping device to thereby rotationally move the latch receiver.

FIG. 4 is a side view showing an example of a breaking mechanism of this type. FIG. 5 is a sectional view taken along line 5—5 in FIG. 4. In FIG. 5, the electric path for each phase in a circuit breaker comprises a current-interrupting section composed of a pair of fixed contact shoes 1 and 2 arranged in a longitudinal direction, and a movable contact shoe 3 bridging across the fixed contact shoes 1 and 2. The movable contact shoe 3 is held by a movable-contact-shoe holder 4 that is composed of an insulator, is provided for each pole, and is pressed against the fixed contact shoes 1 and 2 by a contact spring 5 composed of a compressed coil spring inserted between the movable contact shoe 3 and a case (not shown). The movable contact shoe 3 interrupts a current by being pressed down by an interrupting lever 7 and separated from the fixed contact shoes 1 and 2, as indicated by the line with alternating one long and two short dashes. The interrupting lever 7 is rotationally driven clockwise as shown in FIG. 5 by the force stored in an interrupting spring 6 composed of a torsion spring. When the movable contact shoe 3 is closed as shown in the figure, the interrupting lever 7 is held at the position indicated by the solid line in the figure to keep the interrupting spring 6 in a force-stored state.

In FIGS. 4 and 5, the illustrated breaking mechanism is formed as a unit, and the parts thereof are supported by a frame 8 having right and left side plates 8*a* (FIG. 5). In FIG. 4, the side plate 8*a* closest to the reader is omitted. The frame 8 has a butterfly-shaped operating handle 9 rotatably movably supported via a handle shaft 10, and the handle shaft 10 has a latch 11 connected thereto to be freely rotationally supported thereat. The latch 11 is separated except for an L-shaped bent portion 11*a* located at a tip thereof, and has right and left side plates so as to sandwich the operating handle 9.

The operating handle 9 is connected to an upper end of an upper link 12 via a connection shaft 13. The upper link 12 is connected at a lower end thereof to an upper end of a lower link 14 via one end of a U-shaped pin 15. The upper link 12 and the lower link 14 have right and left side plates, respectively. The upper link 12 sandwiches the operating handle from both sides thereof, whereas the lower link 14 sandwiches the upper link 12 from both sides thereof. The U-shaped pin 15 has its other end engaging the latch 11 to bind the upper link 12 and the lower link 14 against the latch 11. The upper link 12 and the lower link 14 constitute a toggle link.

The lower link 14 has a transmission pin 16 installed at a lower end thereof. The transmission pin 16 has both ends inserted and guided into slits 17 formed in the respective frame side plates 8*a*. The interrupting lever 7 has the other transmission pin 18 installed thereon so as to cross the transmission pin 16. That is, this mechanism includes a pair of interrupting levers 7 each having opposite ends thereof coupled to an opening-and-closing shaft 19 with a space therebetween, which is rotationally movably supported on a case (not shown). The transmission pin 18 is installed so as to extend between the interrupting levers 7. The opening-and-closing shaft 19 has a pair of interrupting springs 6 fitted on the respective ends thereof, wherein one end engages the transmission pin 18, and the other end engages the frame 8, respectively. The interrupting spring 6, however, has been twisted and is in a force-stored state such that it applies a push-up force P from the transmission pin 18 to the transmission pin 16 as shown in FIG. 4, so as to rotationally move the interrupting lever 7 clockwise as shown in FIG. 5.

The above force P causes the transmission pin 16 of the lower link 14 to move upward along the slit 17, so that the lower link 14 starts to rotationally move counterclockwise as shown in FIG. 4, using the transmission pin 16 as a support point. Since, however, the upper end of the lower link 14 is bound by the U-shaped pin 15, the lower link 14 can not move, so that it maintains the illustrated position. At the same time, tensile force Q from the lower link 14 acts on the latch 11 via the U-shaped pin 15. Thus, the latch 11 starts to rotationally move clockwise as shown in FIG. 4 using the handle shaft 10 as a support point. The latch 11, however, is engaged and locked by the latch receiver 20 to maintain the illustrated position.

The latch receiver 20 is shaped like a plate extending in a vertical direction and having a pair of arms 20*a* folded in basically the middle thereof and spaced in a lateral direction. The plate portion of the latch receiver 20 has a square window slit near the arms 20*a*. The latch receiver 20 is supported on the frame 8 via a support shaft 21 penetrating the arms 20*a*, so as to move freely rotationally, and is engaged and locked so that an engaging surface at a lower edge of the window slit engages an engaging surface 11*b* of the latch 11, to thereby prevent the latch 11 from rotationally moving. The latch receiver 20 receives force from the latch 11 and starts to rotationally move clockwise as shown in FIG. 4. A laterally projecting tongue 20*c*, however, abuts against a notched edge of the frame side plate 8*a* to prevent the latch receiver 20 from rotationally moving. Thus, the latch receiver 20 is kept in the illustrated standing position. Further, a return spring 22 composed of a compression coil spring is inserted between a lower end of the latch receiver 20 and the frame 8 to urge the latch receiver 20 clockwise as shown in FIG. 4.

With the breaking mechanism, when the current flowing through the circuit breaker becomes excessive, the latch receiver 20 undergoes a tripping-operation force R from an overcurrent tripping device (not shown) to rotationally move counterclockwise to the position indicated by the broken line, as shown in FIG. 4. The latch 11 is then disengaged and becomes rotationally movable clockwise. As a result, the toggle links 12 and 14 change into a V shape to rotationally drive the interrupting lever 7 clockwise as shown in FIG. 5, using the force stored in the interrupting spring 6. The interrupting lever 7 pushes the movable contact shoe 3 downward via the movable-contact-shoe holder 4 to open and separate it from the fixed contact shoes 1 and 2, thereby interrupting the current.

FIG. 6 is an enlarged vertical sectional view showing a conventional engaging portion between the latch 11 and the latch receiver 20 in the breaking mechanism described above. In FIG. 6, the latch 11 has an engaging surface 11*b* that engages an engaging surface 20*b* of the latch receiver 20. The engaging surfaces 11*b* and 20*b* are both flat, and if they contact with each other at, for example, a point S, then at this point S, an engaging force T from the latch 11 acts on the latch receiver 20 on the basis of the force Q (FIG. 4), which acts on the latch 11.

When an overcurrent occurs as described above, the following four types of tripping-operation loads are required to rotationally drive the latch receiver 20 counterclockwise: sliding frictional loads acting in sliding the engaging surface 11*b* from the engaging surface 20*b*, frictional loads acting between the latch receiver 20 and the support shaft 21, resistance from the return spring 22, and a rotational moment M (FIG. 6) in a clockwise direction due to the engaging force T, which acts on the engaging surface 20*a*. When the length of the arm from the axis of the support shaft 21 to the acting line of the engaging force T is defined as r, the rotational moment M=rT.

With such a conventional breaking mechanism, if the engaging point between the latch 11 and the latch receiver 20 changes, for example, from S to S' as shown in FIG. 6, due to the accuracy of the parts of the mechanism or the accuracy of the assembly, thereby changing the length of the arm by $\Delta r$, the rotational load M will change to $(r+\Delta r)$ T. That is, a change in the location of the engaging point S directly affects the rotational load M. Thus, the operational loads on the latch receiver 20 are easily affected by the accuracy of the parts of the breaking mechanism or the accuracy of the assembly, thereby changing the tripping-operation characteristics. Strictly speaking, when the location of the engaging point S changes, the engaging force T also changes. Since, however, the length m (FIG. 4) of the arm from the handle shaft 10, which supports the latch 11, to the acting line of the engaging force T is sufficiently large as compared to the change in the location of the engaging point S, the change in the engaging force T is negligible.

On the other hand, as the rated current increases, the spring constant of the interrupting spring 6 increases, and correspondingly, the engaging force T increases. Accordingly, if the same latch 11 and latch receiver 20 are used in a large-sized device, the friction between the engaging surfaces 11*b* and 20*b* increases to thereby increase the wear thereof to drastically vary the tripping-operation characteristics over time.

The present invention has been made in view of these problems, and it is an object of the invention to restrain the change in the location of the engaging point between the latch and the latch receiver, as well as the wear of the engaging surfaces, thereby obtaining stable operational characteristics over an extended period.

Further objects and advantages of the invention will be apparent from the following description of the invention.

SUMMARY OF THE INVENTION

To attain the above object, the present invention provides a breaking mechanism for a circuit breaker comprising a latch supported rotationally movably, and a latch receiver supported rotationally movably and normally engaging and locking the latch to prevent the rotational movement thereof. The latch locks a toggle link to keep an interrupting spring in a force-stored state when a movable contact shoe is closed. The latch is released from the engagement, and then rotationally moved to unlock the toggle link in order to open the movable contact shoe using the force stored in the interrupting spring when the current flowing through the circuit breaker becomes excessive, to operate a tripping device to thereby rotationally move the latch receiver. A surface of the latch that engages the latch receiver is formed as a projecting circular surface, and a surface of the latch receiver that engages the projecting circular surface is formed as a recessed circular surface, which has a radius of curvature larger than that of the projecting circular surface.

With such means, the acting line of the force T from the latch, which acts on the latch receiver, always passes through the center of the curvature of the recessed circular surface, regardless of the location of the engaging point S. This minimizes the change in the length r of the arm caused by the change in the location of the engaging point S.

Further, a surface-treated layer composed of a low-friction layer as a surface and a hardened layer located under the low-friction layer is formed on one or both of the respective engaging surfaces of the latch and latch receiver. The engaging surfaces of the latch and latch receiver have the surface-treated layer composed of the low-friction layer as a surface, and a hardened layer located under the low-friction layer, so that this configuration reduces the wear of the engaging surfaces even in a large-sized device, thereby maintaining stable operational characteristics over an extended period. Preferably, the low-friction layer is composed of a nickel-plated layer, and the hardened layer is composed of a carburized layer.

In the invention, if the center of the curvature of the recessed circular surface coincides with the axis of a rotationally moving support shaft of the latch receiver, the acting line of the force T passes through the axis of the rotationally moving support shaft and the length of the arm r becomes zero, thereby eliminating the change in the length r of the arm caused by the change in the location of the engaging point S.

DETAILED DESCRIPTION OF PREFERRED EMBODIMENTS

Figure 1:
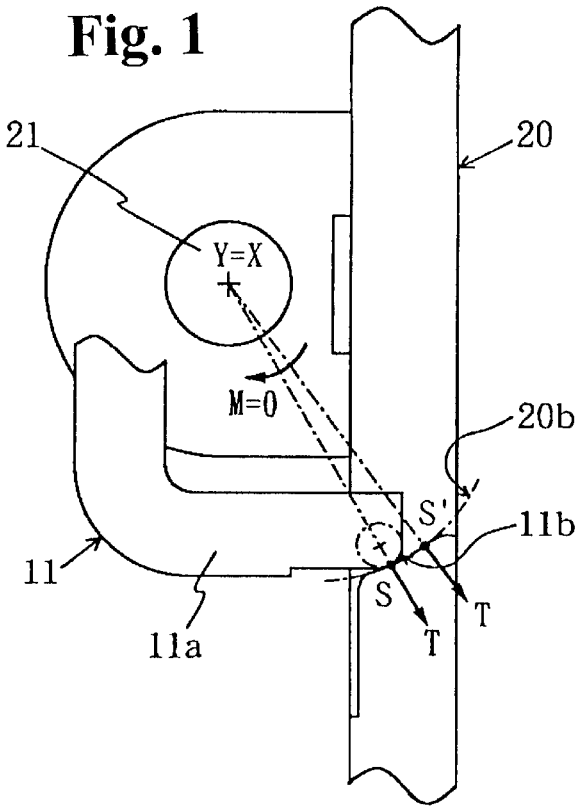
FIG. 1 is a vertical sectional view of an essential part of a breaking mechanism showing an embodiment of the present invention.

FIG. 1 is a vertical sectional view of an engaging portion between a latch and a latch receiver, showing an embodiment of the present invention. The configuration in this figure differs from the conventional one in that the engaging surface 11*b* of the latch 11 that engages the latch receiver 20 is formed as a projecting circular surface, whereas the engaging surface 20*b* of the latch receiver 20, which engages the projecting circular surface 11*b*, is formed as a recessed circular surface having a radius of curvature larger than the projecting circular surface 11*b*. Further, in FIG. 1, the center X of the curvature of the recessed circular surface 20*b* coincides with the axis Y of the rotationally moving support shaft 21 (Y=X). Thus, in FIG. 1, the acting line of the engaging force T passes through the axis Y of the support shaft as shown in the figure (r=0), so that no rotational load M, which is based on the engaging force T, is imposed on the latch receiver 20. Consequently, the rotational load M is always zero despite a change in the location of the engaging point from S to S'.

Figure 3:
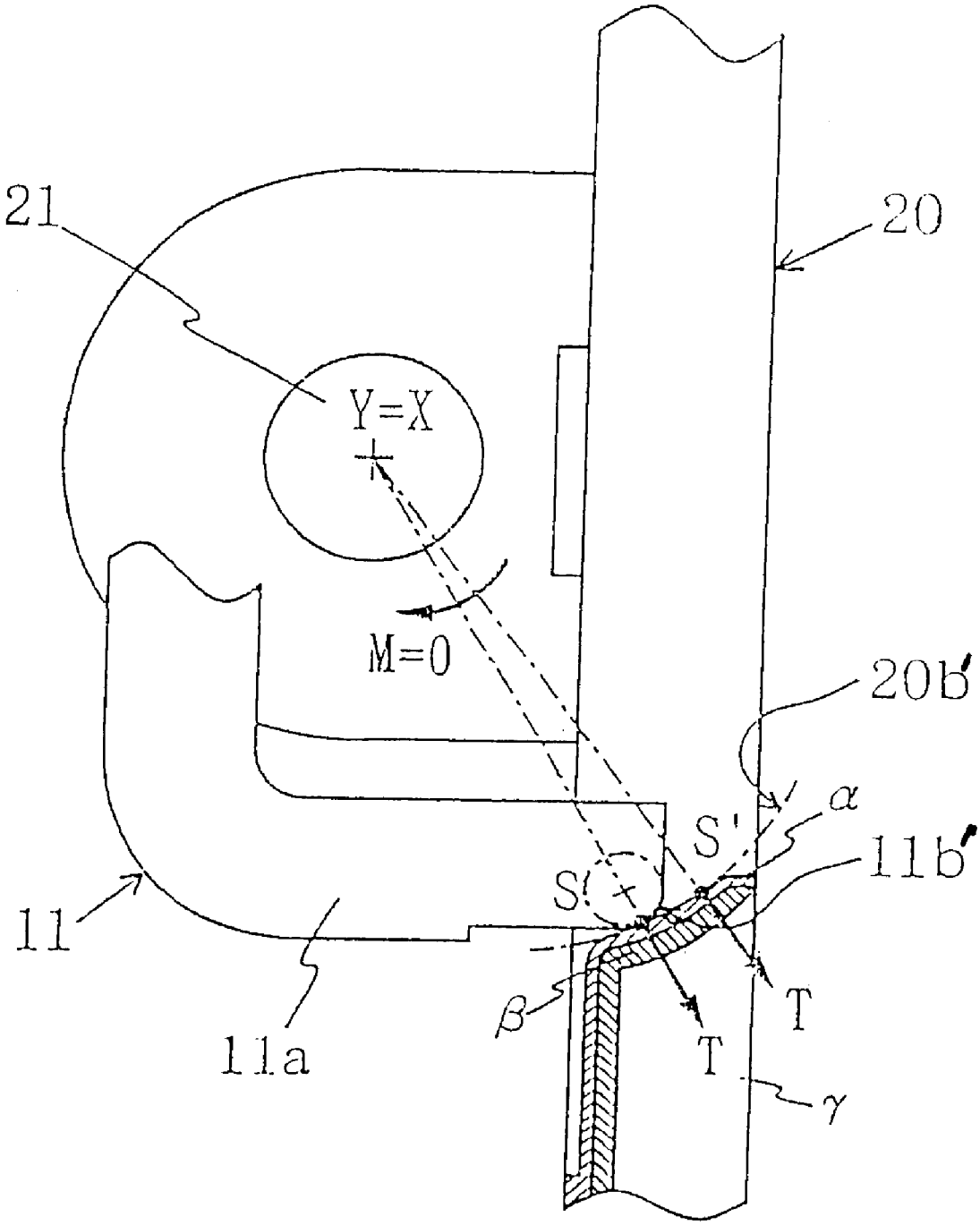
FIG. 3 is a sectional view of an essential part of a breaking mechanism showing another embodiment of the present invention.

On the other hand, in FIG. 3, the latch receiver 20 has a surface-treated layer that is formed on the engaging surface 20*b'* and is composed of a low-friction layer a as a surface, and a hardened layer β located under the low-friction layer α. In this case, a base material γ of the latch receiver 20 is composed, for example, of a cold-cured steel plate (SPCC). On the engaging surface 20*b'*, a hardened layer β is first formed by carburization hardening, and a nickel-plated layer is then applied to the surface of the hardened layer β to form the low-friction layer α. The low-friction layer a reduces the friction generated when the engaging surface 11*b* slips the engaging surface 20*b'*, reduces the tripping-operation load, and increases the wear life or duration of the engaging surface 20*b'*. Further, the hardened layer β prevents the engaging surface 20*b* from being deformed by the engaging force T. That is, these surface-treated layers a and β reduce the friction with the engaging surface 20*b'* while increasing the strength thereof, so that tripping characteristics as reduced loads and an extended life time can be obtained even if the latch receiver 20 is used in a large-sized device. The surface-treated layers a and B can also be formed on the engaging surface 11*b* of the latch 11.

Figure 4:
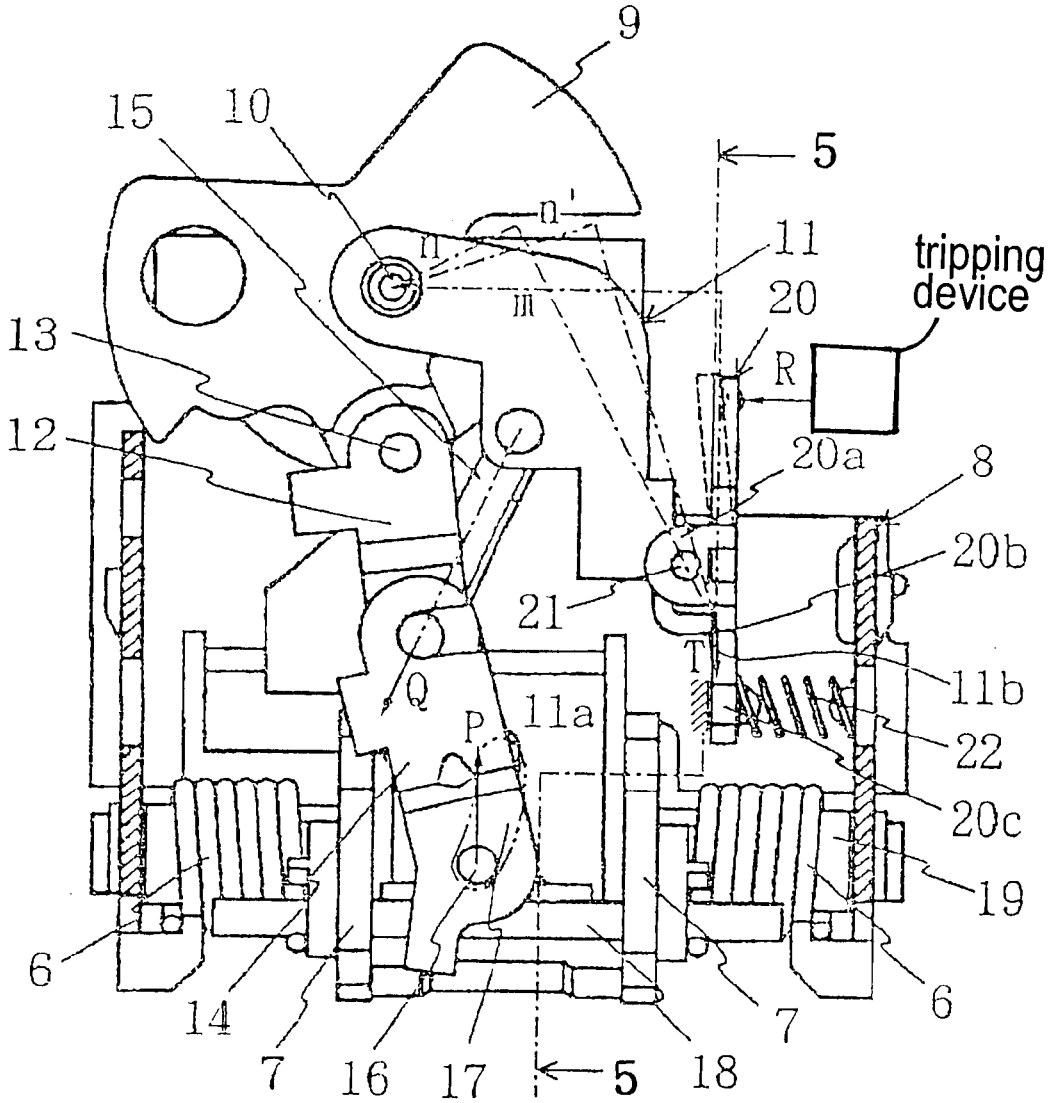
Fig. 4 Prior Art
FIG. 4 is a side view showing a conventional breaking mechanism.
Figure 5:
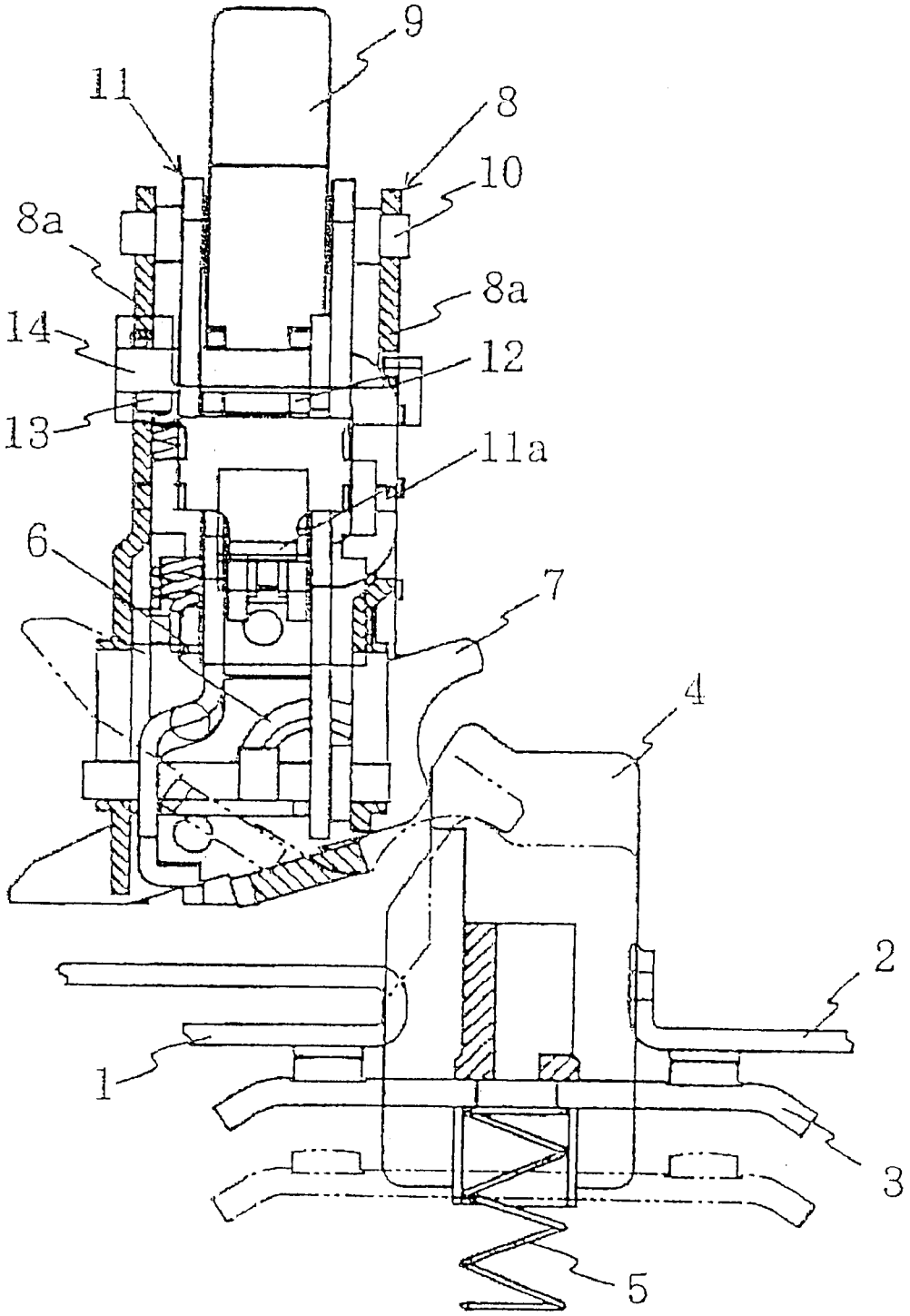
Fig. 5 Prior Art
FIG. 5 is a sectional view taken along line 5—5 in FIG. 4.
Figure 6:
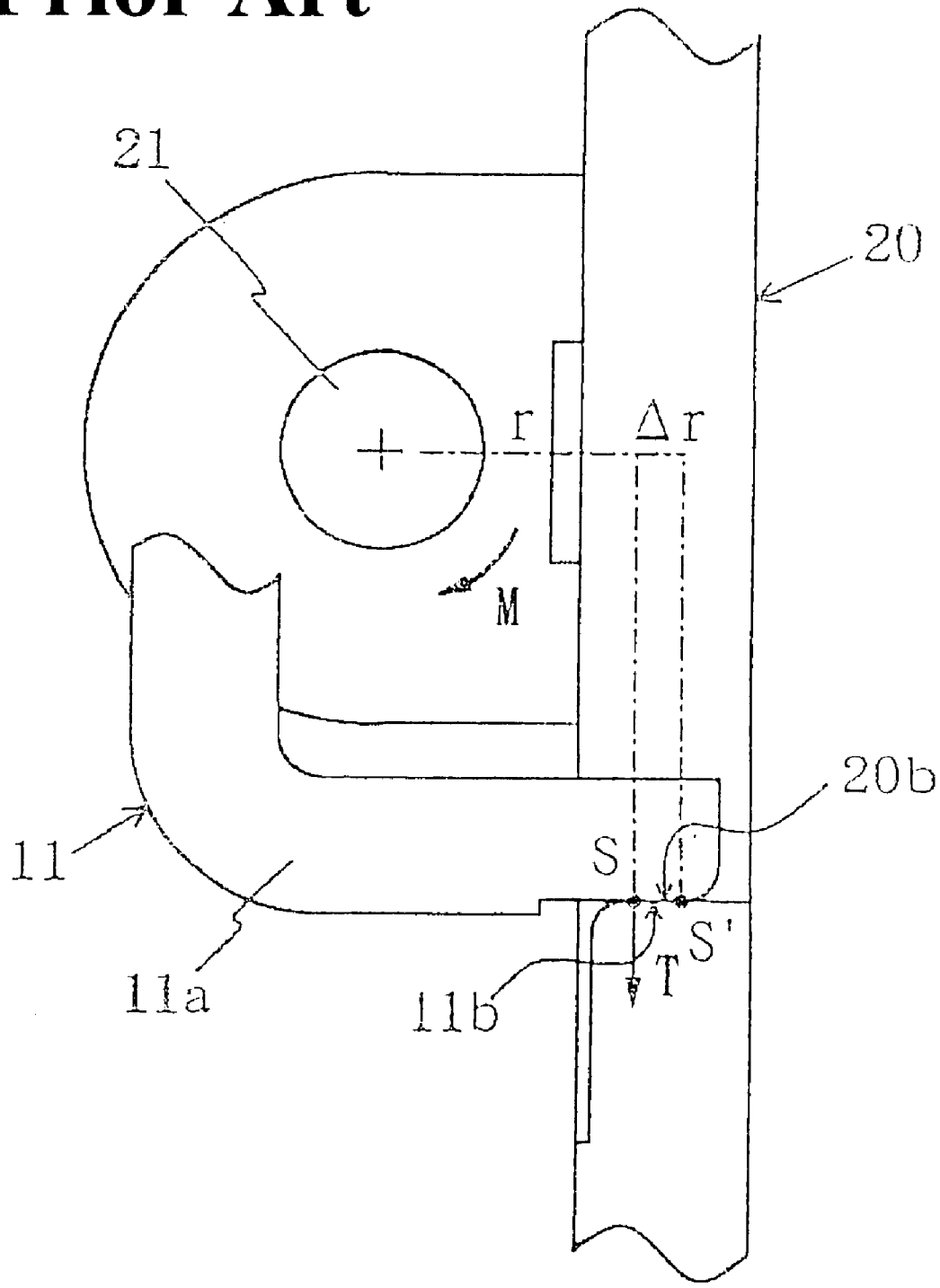
Fig. 6 Prior Art
FIG. 6 is a vertical sectional view of an essential part of FIG. 4.

In FIG. 1, the acting line of the engaging force T inclines toward the support shaft 21, so that the length n of the arm from the handle shaft 10 to the acting line of the engaging force T is smaller than that shown in FIG. 6 (n<m), as shown in FIG. 4. Thus, the frictional load between the engaging surfaces 11*b* and 20*b* increases.

Figure 2:
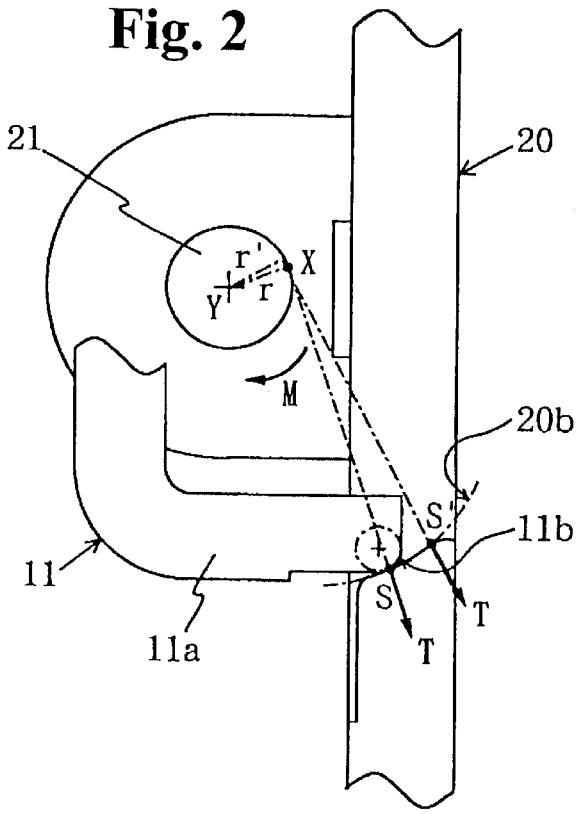
FIG. 2 is a vertical sectional view of an essential part of a breaking mechanism showing a different embodiment of the present invention.

To reduce this load, the center X of the curvature of the engaging surface 20*b* may be shifted from the axis of the support shaft 21 toward the opposite side of the latch, as shown in the embodiment in FIG. 2. That is, in FIG. 2, the center X of the curvature is set, for example, on an outer peripheral surface of the support shaft 21. This reduces the inclination of the acting line of the engaging force T, while increasing the length of the arm shown in FIG. 4 from n to n' (n'>n), thereby restraining the engaging force T. Further, in FIG. 2, when the engaging point changes from S to S', the length of the arm from the axis of the support shaft 21 to the acting line of the engaging force T changes from r to r'. This change, however, is small (r=r'), and the rotational load M on the latch receiver 20, which is induced by the engaging force T, remains virtually unchanged.

As described above, according to the present invention, even if the location of the engaging point between the latch and the latch receiver varies due to the parts or the assembly accuracy, the magnitude of the rotational load based on the engaging force applied to the latch receiver by the latch is virtually unaffected. Further, the engaging surfaces are protected from wear or deformation even in a large-sized device, thereby providing stable tripping characteristics over an extended period.

While the invention has been explained with reference to the specific embodiments of the invention, the explanation is illustrative and the invention is limited only by the appended claims.

What is claimed is:

1. A breaking mechanism for a circuit breaker comprising:

an operation handle, a fixed contact and a movable contact to be moved relative to the fixed contact, a toggle link connected to the operation handle to actuate the movable contact, a tripping device for moving the movable contact away from the fixed contact when a current flowing through the circuit breaker becomes excessive, an interrupting spring situated near the movable contact to urge the movable contact in a direction away from the fixed contact when the tripping device operates, a rotationally supported latch having a projecting circular surface at one end, said latch locking the toggle link to keep the interrupting spring in a force-stored state when the movable contact is closed, said latch being released and rotationally moved to unlock the toggle link to thereby open the movable contact using the force stored in the interrupting spring when the tripping device operates, and a rotationally supported latch receiver to engage and lock the latch to prevent a rotational movement of the latch, said latch receiver having an engaging portion engaging the projecting circular surface of the latch and having a recessed circular surface with a radius of curvature greater than that of the projecting circular surface of the latch.

2. A breaking mechanism for a circuit breaker according to claim 1, wherein one of said projecting circular surface and recessed circular surface includes a surface-treated layer composed of a low-friction layer as a surface and a hardened layer located under the low-friction layer.

3. A breaking mechanism for a circuit breaker according to claim 2, wherein said low-friction layer is composed of a nickel-plated layer, and said hardened layer is composed of a carburized layer.

4. A breaking mechanism for a circuit breaker according to claim 1, wherein the curvature of the recessed circular surf ace has a center coinciding with an axis of a rotationally moving support shaft of said latch receiver.

5. A breaking mechanism for a circuit breaker according to claim 1, wherein the curvature of the recessed circular surface has a center in an axis of a rotationally moving support shaft of the latch receiver.

* * * * *

UNITED STATES PATENT AND TRADEMARK OFFICE

CERTIFICATE OF CORRECTION

PATENT NO. : 6,621,020 B2
DATED : September 16, 2003
INVENTOR(S) : Kentaro Toyama et al.

It is certified that error appears in the above-identified patent and that said Letters Patent is hereby corrected as shown below:

Column 1,
Line 3, after "AND" add -- RELATED --;

Column 5,
Line 18, change "a" in second occurrence to -- α --;
Lines 25 and 31, change "a" to -- α --;
Line 36, change "a and B" to -- α and β --; and
Line 56, change "(r=r′)" to -- (r≒r′) --.

Signed and Sealed this

Fourth Day of November, 2003

JAMES E. ROGAN
*Director of the United States Patent and Trademark Office*